US007215920B2

(12) United States Patent
Shida

(10) Patent No.: US 7,215,920 B2
(45) Date of Patent: May 8, 2007

(54) IMAGING FORMING APPARATUS

(75) Inventor: Masanori Shida, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 164 days.

(21) Appl. No.: 11/107,734

(22) Filed: Apr. 18, 2005

(65) Prior Publication Data

US 2005/0232668 A1 Oct. 20, 2005

(30) Foreign Application Priority Data

Apr. 20, 2004 (JP) ..... 2004-123820

(51) Int. Cl.
*G03G 21/00* (2006.01)
*G03G 15/16* (2006.01)

(52) U.S. Cl. ..... 399/354; 399/101

(58) Field of Classification Search ..... 15/256.5, 15/256.51; 399/99, 101, 352, 353, 354, 357
See application file for complete search history.

(56) References Cited

U.S. PATENT DOCUMENTS 5,655,204 A * 8/1997 Siegel ..... 399/349
5,729,815 A * 3/1998 Lindblad et al. ..... 399/354
6,775,512 B2 * 8/2004 Thayer ..... 399/353

FOREIGN PATENT DOCUMENTS

JP 2002-207403 7/2002

* cited by examiner

*Primary Examiner*—Hoang Ngo
(74) *Attorney, Agent, or Firm*—Fitzpatrick, Cella, Harper & Scinto

(57) ABSTRACT

An image forming apparatus which can quickly remove remaining toner even after it has been emergently stopped when it forms an image by the use of an intermediate transfer member. An image forming apparatus for primary-transferring a toner image formed on a photosensitive drum to an intermediate transfer belt by a primary transfer roller, and secondary-transferring the primary-transferred image to a recording material to thereby form an image has a secondary cleaning portion for applying a bias to a plurality of fur brushes, wherein during ordinary image forming, biases of different polarities are applied to the plurality of fur brushes to thereby effect cleaning, and during a returning operation after emergent stoppage, biases of the same polarity are applied to the plurality of fur brushes to thereby effect cleaning.

3 Claims, 3 Drawing Sheets

IMAGING FORMING APPARATUS

BACKGROUND OF THE INVENTION

1. Field of the Invention

The invention relates to an image forming apparatus adapted to form a toner image on an image bearing member, and transfer this toner image to a recording material, and particularly to an image forming apparatus of an electrophotographic type or an electrostatic recording type.

2. Description of Related Art

As a plural-color or full-color image forming apparatus of a conventional electrophotographic type, in recent years, there has been proposed an image forming apparatus of an intermediate transfer type in which toner images of respective colors formed on a photosensitive drum are successively superposed on an intermediate transfer member (intermediate transfer belt) to thereby form a color image, which is then collectively transferred to a recording sheet.

In this intermediate transfer type, a toner image is formed on the photosensitive drum by charging means, exposing means and developing means disposed around the photosensitive drum, and is electrostatically transferred to the intermediate transfer belt by transferring means in a primary transferring portion. When a color image is to be formed, toner images are successively transferred to the intermediate transfer belt, whereby a full-color image can be formed on the intermediate transfer belt.

The toner image transferred to the intermediate transfer belt is conveyed to a secondary transferring portion by the rotation of the intermediate transfer belt, and is electrostatically transferred to a recording medium. As methods of removing toner not transferred to the recording medium at this time, but remaining on the intermediate transfer belt, there have been proposed a method of pushing a cleaning blade against the intermediate transfer belt to thereby remove the remaining toner, a method of applying a bias to fur brush cleaning means to thereby electrostatically remove the remaining toner, etc.

The afore described fur brush cleaning is advantageous to such problem as the influence upon the life of the intermediate transfer belt which poses a problem in the blade cleaning means, or the load fluctuation by the fluctuation of frictional resistance, but the untransferred remaining toner after the secondary transfer includes some toner charged to the plus (+) polarity by the secondary transfer bias and some toner charged to the minus (−) polarity by the secondary transfer bias and therefore, there arises the problem that not all of the untransferred remaining toner can be completely collected by a single fur brush and by the application of a bias of one polarity. Against this problem, there has been proposed a method of applying bias voltages of different polarities, i.e., plus (+) and minus (−) polarities, to a plurality of fur brushes to thereby collect untransferred remaining toner after the secondary transfer (Japanese Patent Application Laid-open No. 2002-207403).

In such an image forming apparatus as described above, it sometimes happen that the image forming operation is interrupted by the faulty conveyance or the like of a recording material while the toner image on the photosensitive drum is being transferred onto the intermediate transfer belt, or while the toner on the intermediate transfer belt is being transferred to a recording sheet. In this case, the image forming apparatus has the return sequence of eliminating the cause, and thereafter performing the returning operation of collecting a toner image already developed on the photosensitive drum, or the toner image already transferred onto the intermediate transfer belt by cleaning means to thereby prepare for the next image formation.

In the toner image transferred onto the intermediate transfer belt at the point of time whereat the image forming has been interrupted, if it is of full-color, there exist toner images of maximum n colors (n>1) comprising monochromatic toner images on the photosensitive drum superposed one upon another. It is necessary to collect these toner images by the return sequence, but the electrostatic fur brush cleaning, unlike a cleaning blade, is limited in the amount of toner it can collect.

In the electrostatic fur brush cleaning, for example, when the charging polarity of the toner is minus (−), toner collecting capability can be increased by making the polarity of the bias applied to the fur brush opposite to the polarity of the toner, namely, into the plus (+) polarity, and increasing the intensity of the bias, but if the intensity of the bias is too much increased, the toner charged to the minus (−) polarity during the collection thereof is charged to the plus (+) polarity by charge injection or discharge, and this leads to the problem that the toner cannot by collected by the fur brush but is discharged onto the intermediate transfer belt. Therefore, the lower limit value of the bias setting of the electrostatic fur brush cleaning means is set to bias intensity by which the untransferred remaining toner can be collected, and the upper limit value thereof is set to bias intensity at which it is difficult for the toner to be reversed during the collection. As the result, the upper limit of the bias intensity puts an upper limit to the collecting capability.

Consequently, if an attempt is made to collect the remaining toner on the intermediate transfer belt by the above-described bias set valve and the method described in Japanese Patent Application Laid-open No. 2002-207403, when the toner is charged to the minus (−) polarity, a bias of the minus (−) polarity is applied to an upstream fur brush and therefore, almost all of the toner repulses and slips through, and a bias of the plus (+) polarity is applied to a downstream fur brush and therefore, the toner is collected, but due to the great amount of toner, much toner cannot be completely collected but slips through. Consequently, to collect all of the toner, it becomes necessary to make the remaining toner image on the intermediate transfer belt pass through the fur brush cleaning many times, and much time is required for the return.

SUMMARY OF THE INVENTION

The present invention has been made in view of the above-noted points, and an object thereof is to provide an image forming apparatus which can quickly remove remaining toner even after it has been urgently stopped when it forms an image by the use of an intermediate transfer member.

In order to solve the above-noted problem, an image forming apparatus according to an embodiment of the present invention is an image forming apparatus comprising: an image bearing member, which moves while bearing a toner image thereon; a transferring member to which a bias of a predetermined polarity is applied to electrostatically transfer the toner image on the image bearing member to a transfer material in a transferring region; a first toner removing member, which removes a toner on the image bearing member; and a second toner removing member, which is provided on a downstream side in a moving direction of the image bearing member, and to which a bias is applied to remove a toner on the image bearing member, wherein when the toner image on the image bearing member is transferred to the transfer material in the transferring region, and when the first and second toner removing members remove a toner remaining on the image bearing member among a toner of the toner image, biases of polarities different from each other are applied to the first and second toner removing members, respectively, and wherein when the toner image on the image bearing member is not transferred to the transfer material in the transferring region, and when the first and second toner removing members remove a toner remaining on the image bearing member, biases of the same polarities are applied to the first and second toner removing members.

The above and other objects, features and advantages of the present invention will become more apparent upon consideration of the following description of the preferred embodiments of the present invention taken in conjunction with the accompanying drawings.

DETAILED DESCRIPTION OF THE PREFERRED EMBODIMENTS

[First Embodiment]

Figure 1:
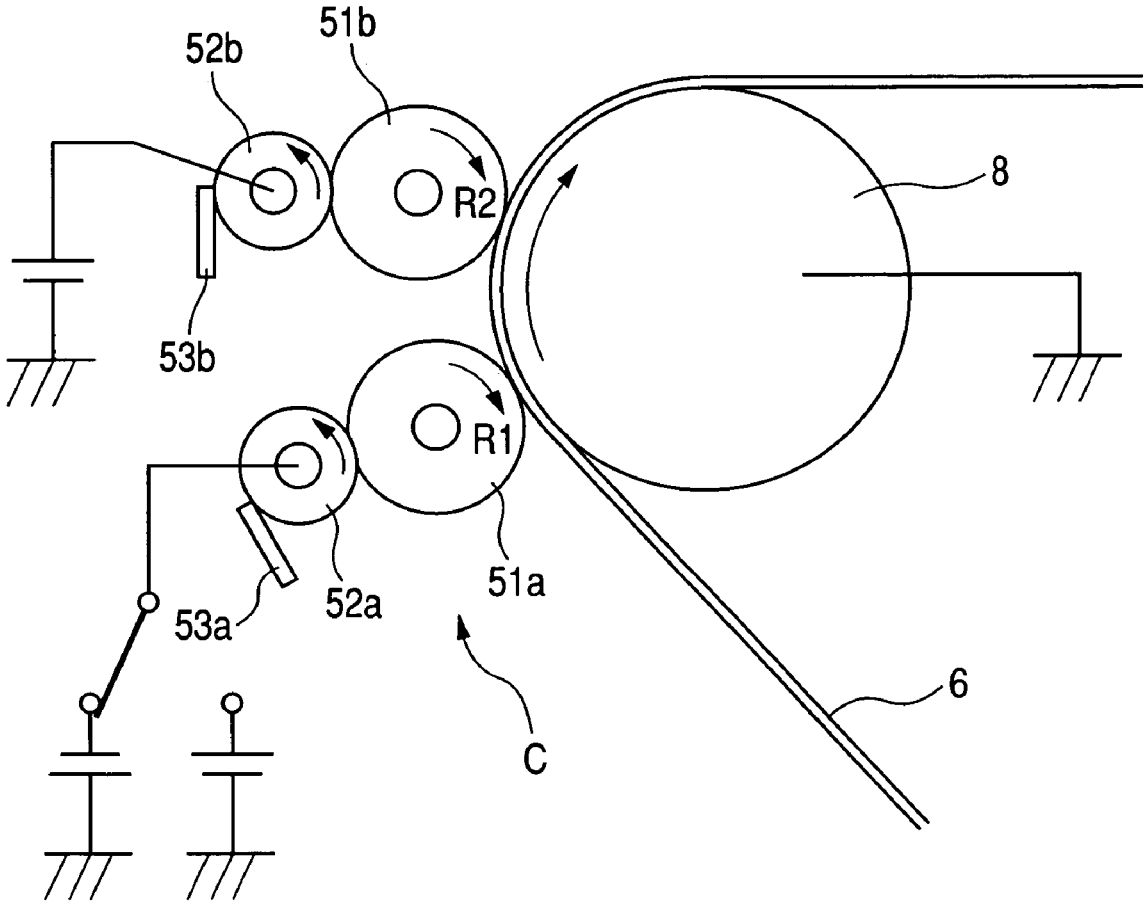
FIG. 1 is an illustration of the construction of a fur brush cleaning portion.
Figure 2:
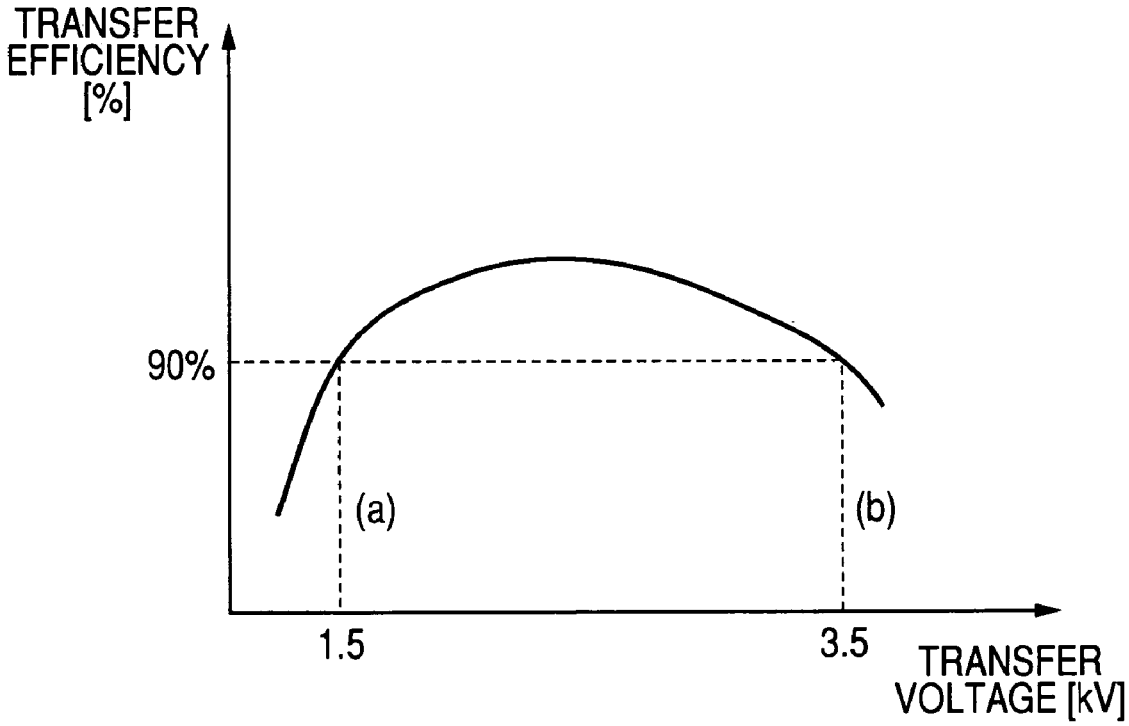
FIG. 2 is a graph showing the relation between a transfer voltage and transfer efficiency in the secondary transferring portion of an image forming apparatus.

An image forming apparatus according to a first embodiment of the present invention will now be described with reference to FIGS. 1 to 3. FIG. 1 is an illustration of the construction of a fur brush cleaning portion, FIG. 2 is a graph showing the relation between a transfer voltage and transfer efficiency in the secondary transferring portion of the image forming apparatus, and FIG. 3 is a typical cross-sectional illustration of the image forming apparatus.

{The General Construction of the Image Forming Apparatus}

Figure 3:
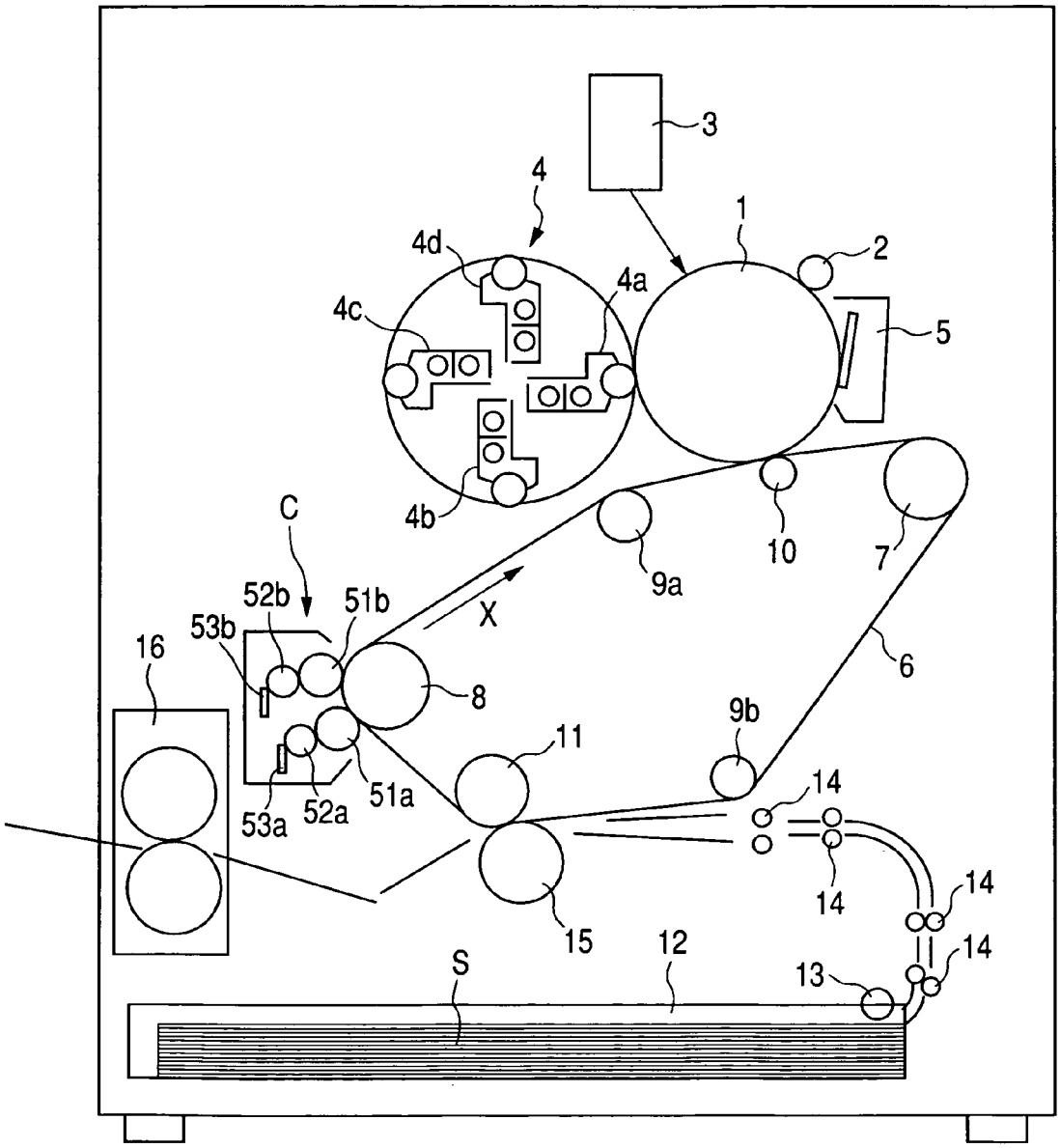
FIG. 3 is a typical cross-sectional illustration of the image forming apparatus.

Reference is first had to FIG. 3 to schematically describe the general construction of the image forming apparatus. The image forming apparatus according to the present embodiment is a full-color image forming apparatus using developers of four colors, i.e., yellow, cyan, magenta and black and is a printer in which images by the developers formed on an image bearing member are primary-transferred to an intermediate transfer member, and the images are secondary-transferred to a recording sheet as a transfer material to thereby obtain a color image.

Each of the developers used in the present embodiment consists chiefly of a toner and a carrier which is a magnetic material, and the toner is negatively chargeable, and the carrier has positive chargeability.

Around a photosensitive drum 1 as a first image bearing member, there are disposed a charging device 2 for uniformly charging the surface of the photosensitive drum 1, exposing means 3 for effecting exposure conforming to an image signal on the charged photosensitive drum to thereby form an electrostatic latent image thereon, four developing devices 4*a*, 4*b*, 4*c* and 4*d* rotatably provided in a developing rotary 4 for forming yellow, cyan, magenta and black toner images on the photosensitive drum 1, and a cleaning portion 5 as primary cleaning means for removing toners remaining on the photosensitive drum 1.

The image forming apparatus according to the present embodiment rotates the developing rotary 4 for each color to thereby effect developing, and repeats the exposure on the photosensitive drum 1 a number of times corresponding to the necessary colors by changing over the developing devices 4*a*, 4*b*, 4*c* and 4*d* each time the exposure is effected, to thereby effect developing, and primary-transfers the developed toner images of the respective colors onto an intermediate transfer belt 6 as an intermediate transfer member which is a second image bearing member so as to be superposed on the belt 6 to thereby obtain a color image.

The intermediate transfer belt 6 is formed of dielectric material resin such as polycarbonate, polyethylene terephthalate resin film, polyvinylidene fluoride resin film, polyimide or ethylene-ethylene tetrafluoride copolymer, and is passed over a drive roller 7, an extending roller 8, tension rollers 9*a*, 9*b*, a primary transfer roller 10 as primary transferring means, and a secondary transfer inner roller 11 and is rotated in the direction indicated by the arrow X in FIG. 3.

The intermediate transfer belt 6 in the present embodiment has an elastic layer as a surface layer. The belt thus having an elastic layer is best suited for a case where a blade cannot be used as cleaning means for the belt, for example, a case where as in the present embodiment, belt cleaning by a fur brush is adopted.

Recording sheets S as recording materials stacked on a sheet cassette 12 mounted on the lower portion of the image forming apparatus are conveyed one by one to a secondary transferring portion by sheet conveying means comprising a feeding roller 13, a pair of conveying rollers 14, etc. so as to be synchronized with image forming on the intermediate transfer belt 6.

Thereafter, in the secondary transferring portion, a bias is applied to a secondary transfer outer roller 15, whereby the color image formed on the intermediate transfer belt 6 is secondary-transferred to the conveyed recording sheet. Then, the recording sheet having passed through the image transferring portion has the toners thereon heat-fixed by a fixing portion 16, and is discharged or is directed to a two-side image forming process.

On the other hand, the intermediate transfer belt 6 from which the toner images have been transferred to the recording sheet has toners remaining thereon removed by a cleaning portion C.

{Cleaning Portion for the Intermediate Transfer Belt}

Description will now be made of the cleaning portion C as secondary cleaning means for removing the toners remaining on the intermediate transfer belt 6.

The remaining toners not transferred to the recording sheet but remaining on the intermediate transfer belt 6 are carried to the cleaning portion C by the rotation of the belt. The cleaning portion C is disposed in opposed relationship with the grounded belt extending roller 8, and in the present embodiment, two fur brushes 51*a* and 51*b* are disposed as a plurality of cleaning members upstream and downstream with respect to the conveying direction of the intermediate transfer belt 6.

This cleaning portion C, like the secondary transfer outer roller 15, is movable toward and away from the intermediate transfer belt 6, and comes into contact with the intermediate transfer belt when the remaining toners on the intermediate transfer belt has been carried to the cleaning portion C.

Each of the fur brushes 51*a* and 51*b* used in the present embodiment comprises an electrical conducting shaft of ϕ8 and electrically conductive and fiber-like hair implanted thereon, and two such brushes having an outer diameter of ϕ20 and a pile length of 6 mm, formed of Nylon and having density of 100 kF and resistance of $5\times10^{6}\Omega$.

FIG. 1 shows the fur brush cleaning portion C used in the present embodiment. Metallic bias rollers 52*a* and 52*b* are disposed downstream of points at which the fur brushes 51*a* and 51*b* are in contact with the belt extending roller 8 so as to come into the fur brushes 51*a* and 51*b*, respectively. Also, scrapers 53*a* and 53*b* are pushed against the downstream side of points at which these metallic bias rollers 52*a* and 52*b* are in contact with the fur brushes 51*a* and 51*b*, respectively, and the toners collected by the fur brushes 51*a* and 51*b* are shifted to the metallic bias rollers 52*a* and 52*b* and are scraped by the scrapers 53*a* and 53*b*, whereby the toners are made to fall into a waste toner box (not shown).

As regards rotational directions, the fur brushes 51*a* and 51*b* are rotated in opposite directions (the direction indicated by the arrow R1) at positions opposed to the intermediate transfer belt 6, and the bias rollers 52*a* and 52*b* are rotated in the same direction (the direction indicated by the arrow R2) at positions opposed to the fur brushes 51*a* and 51*b*. As regards the delivery of the toners from the intermediate transfer belt 6 to the fur brushes 51*a* and 51*b*, when +700V is applied to the bias rollers 52*a* and 52*b*, a voltage of +600V is induced in the fur brushes 51*a* and 51*b*, and a potential difference occurs between the fur brushes and the grounded extending roller 8, whereby the toners on the intermediate transfer belt 6 are shifted to the fur brushes 51*a* and 51*b*. Further, the toners collected by the fur brushes 51*a* and 51*b* are shifted to the bias rollers 52*a* and 52*b* by the potential difference between the fur brushes 51*a*, 51*b* and the bias rollers 52*a*, 52*b*. As shown in FIG. 1, a bias of the two polarities (+) and (−) are applicable to one bias roller 52*a*.

In the present embodiment, during ordinary image forming, a bias of the minus (−) polarity is applied to the upstream bis roller 52*a* with respect to the rotational direction of the intermediate transfer belt 6, and a bias of the plus (+) polarity is applied to the downstream bias roller 52*b*. That is, −700V is applied to the upstream bias roller 52*a*.

This is because there is the possibility that toners of the two polarities, i.e., the plus (+) polarity and the minus (−) polarity, may exist in the remaining toners on the intermediate transfer belt 6 after the completion of secondary transfer, and thus, design is made such that biases of different polarities are applied to the two fur brushes 51*a* and 51*b*.

FIG. 2 shows a graph of the applied voltage (transferring voltage) to the secondary transfer roller and transfer efficiency in the secondary transferring portion in the present embodiment. Dotted lines (a) and (b) in this graph indicate the transferring voltages during the transfer efficiency of 90%, The transfer efficiency was found by (the transfer efficiency=the amount of toner transferred to the recording sheet/the amount of toner on the intermediate transfer member before transfer×100(%)). Voltages corresponding to the dotted lines (a) and (b) are 1.5 kV and 3.5 kV, respectively, thus differing from each other, but when the transferring voltage is set to 1.5 kV, the remaining toners on the intermediate transfer member are chiefly of the minus (−) polarity, and when the transferring voltage is 3.5 kV, toners chiefly of the plus (+) potarity are more remaining. This occurs due to the deficiency of the transferring voltage relative to the charges of the transferred toners in the case of setting to 1.5 kV, and in the case of setting to 3.5 kV, is attributable to the fact that the transferring voltage is too high, whereby the polarity of the charges of the toners is reversed by the injection of charges into the toners or the jumping-in of charges due to discharge.

For the reason set forth above, design is made such that two fur brushes 51*a* and 51*b* are adopted and biases of different polarities are applied thereto.

{Return Sequence after the Interruption of Image Forming}

In the above-described image forming apparatus, the image forming operation is sometimes interrupted by the faulty conveyance of the recording sheet P while the toner image on the photosensitive drum 1 is being transferred onto the intermediate transfer belt 6, or while the toners on the intermediate transfer belt 6 are being transferred to the recording sheet P.

In that case, regarding the toner images remaining on the intermediate transfer belt 6 which have not passed through the secondary transferring portion 40, the toners are remaining while remaining charged regularly. In the case of a full-color image, there exist toner images of maximum n colors (n>1) comprising monochromatic toners on the photosensitive drum 1 superposed one upon another.

It is necessary to remove the above-described toners by a return sequence, but electrostatic fur brush cleaning is limited in the amount of toner collectable at a time by a conventional construction. At this time, to remove all of the toners remaining on the intermediate transfer belt 6, the intermediate transfer belt 6 must be made to pass through the cleaning portion C several times, and much time is required for return, as previously described.

In contrast, in the image forming apparatus according to the present embodiment, during the returning operation after image forming has been interrupted midway thereof, a bias of the plus (+) polarity which is opposite to the polarity of the toners charged to the minus (−) polarity is applied to both of the two bias rollers 52*a* and 52*b* to thereby collect the toners on the intermediate transfer belt 6.

That is, in the present embodiment, a bias of the plus (+) polarity is given to the downstream bias roller 52*a*, and the both polarities are given to the upstream bias roller 52*a*, and (1) during ordinary image forming, the upstream bias roller 52*a* is set to a bias of the minus (−) polarity, and the downstream bias roller 52*b* is set to a bias of the plus (+) polarity. on the other hand, (2) during the return sequence after emergent stoppage, the upstream bias roller 52*a* is changed over to the bias of the plus (+) polarity, and the downstream bias roller 52*b* is changed over to the bias of the plus (+) polarity.

As described above, in the return sequence after the emergent stoppage, unlike during the ordinary image forming, a (+) bias opposite in polarity to the charged toners is applied to both of the two bias rollers 52*a* and 52*b* to thereby first collect the toners by the upstream fur brush 51*a*, and further collect the toners of the minus (−) polarity on the intermediate transfer belt 6 which could not be completely removed by the upstream fur brush 51*a*, also by the downstream fur brush 51*b* to which the (+) bias has been applied. Thereby, as compared with during the ordinary image forming, a great toner collecting effect can be obtained.

Also, even if it slips through the two fur brushes, the toner of the minus (−) polarity can be reversely transferred to the photosensitive drum 1 by a (−) bias opposite in polarity to the ordinary image forming being applied to the primary transfer roller 10, and can be collected by a primary cleaning portion 5 for the photosensitive drum 1.

The primary cleaning portion 5 uses a blade member as a cleaning member to thereby scrape off the toners on the photosensitive drum 1. The use of the blade member leads to the ease of the construction of the primary cleaning portion 5.

Also, the toners charged to the minus (−) polarity which have slipped through the two fur brushes 51*a* and 51*b* can be collected by the fur brush cleaning portion C during the second rotation.

While in the present embodiment, description has been made of the image forming apparatus for obtaining a full-color image, of course, a similar effect can also be obtained in an image forming apparatus for obtaining a monochromatic image.

[Second Embodiment]

In the afore described first embodiment, design is made such that during the returning operation after the urgent stoppage, a bias of the plus (+) polarity is applied to the two bias rollers 52*a* and 52*b* at the first rotation of the intermediate transfer belt 6, but in this embodiment, further at the second rotation of the intermediate transfer belt 6 in the returning operation, a (−) bias is applied to the upstream bias roller 52*a* and a (+) bias is applied to the downstream bias roller 52*b*.

In a case where the maximum bearing amount of the toner further increases relative to the image forming apparatus according to the afore described first embodiment, there comes out a toner slipping through the two-fur-brush cleaning portion C while remaining charged to the minus (−) polarity. Even if an attempt is made to reversely transfer this toner of the minus (−) polarity onto the photosensitive drum by the application of a bias to the primary transfer roller 10, depending on the value of the reversely transferring bias, a toner remaining while remaining of the minus (−) polarity or a toner reversed to the plus (+) polarity by receiving the reversely transferring bias becomes remaining on the intermediate transfer belt.

So, in the present embodiment, during the fur brush cleaning at the first rotation of the intermediate transfer belt 6 in the returning operation, as described in the first embodiment, a (+) bias is applied to both of the fur brushes 51*a* and 51*b* to thereby effect cleaning, but during the fur brush cleaning at the second rotation, a (−) bias is applied to the upstream fur brush and a (+) bias is applied to the downstream fur brush to thereby collect the toners on the intermediate transfer belt 6 charged to the two polarities. That is, (3) At the first rotation during the return sequence after emergent stoppage, the upstream bias roller 52*a* is changed over to a bias of the plus (+) polarity, and the downstream bias roller 52*b* is changed over to a bias of the plus (+) polarity, and (4) at the second rotation during the return sequence after emergent stoppage, the upstream bias roller 52*a* is changed over to a bias of the minus (−) polarity, and the downstream bias roller 52*b* is changed over to a bias of the plus (+) polarity.

Thereby, the returning operation after emergent stoppage can be recovered within the shortest time.

[Other Embodiments]

While in the afore described embodiments, there has been shown an example in which a blade member is used as the primary cleaning means, the primary cleaning portion 5, like the secondary cleaning portion C, may use a fur brush and a bias opposite in polarity to the toners may be applied thereto. If this is done, the toners on the photosensitive drum 1 can be collected more efficiently.

Also, while in the afore described embodiments, there has been shown an example in which fur brushes are used as cleaning members for contacting with the intermediate transfer member to thereby remove secondary transfer remaining toners, electrically conductive rollers may be used and design may be made such that the bias as previously described is applied thereto, to obtain an effect similar to that of each of the afore described embodiments.

According to the present embodiment, during the returning operation after emergent stoppage, biases of the same polarity are applied to a plurality of cleaning members to thereby effect the removal of the untransferred remaining toners on the intermediate transfer member, whereby even if a great deal of toner is remaining on the intermediate transfer member, the remaining toner can be collected efficiently within a short return time.

While the invention has been described with reference to the structure disclosed herein, it is not confined to the details set forth and this application is intended to cover such modifications or changes as may come within the purpose of the improvements or the scope of the following claims.

This application claims priority from Japanese Patent Application No. 2004-123820 filed Apr. 20, 2004, which is hereby incorporated by reference herein.

What is claimed is:

1. An image forming apparatus comprising:

an image bearing member, which moves while bearing a toner image thereon;

a transferring member to which a bias of a predetermined polarity is applied to electrostatically transfer the toner image on said image bearing member to a transfer material in a transferring region;

a first toner removing member, which removes a toner on said image bearing member; and a second toner removing member, which is provided on a downstream side in a moving direction of said image bearing member, and to which a bias is applied to remove a toner on said image bearing member, wherein when the toner image on said image bearing member is transferred to the transfer material in the transferring region, and when said first and second toner removing members remove a toner remaining on said image bearing member, biases of polarities different from each other are applied to said first and second toner removing members, respectively, and wherein when the toner image on said image bearing member is not transferred to the transfer material in the transferring region, and when said first and second toner removing members remove a toner remaining on said image bearing member, biases of the same polarities are applied to said first and second toner removing members.

2. An image forming apparatus according to claim 1, wherein when the toner image on said image bearing member is transferred to the transfer material in the transferring region, and when said first and second toner removing members remove the toner remaining on said image bearing member, a bias of a polarity different from said predetermined polarity is applied to said first toner removing member and a bias of the same polarity as said predetermined polarity is applied to said second toner removing member.

3. An image forming apparatus according to claim 1 or 2, wherein when the toner image on said image bearing member is not transferred to the transfer material in the transferring region, and when said first and second toner removing members remove the toner remaining on said image bearing member, the biases of the same polarities as said predetermined polarity are applied to said first and second toner removing members.

* * * * *

UNITED STATES PATENT AND TRADEMARK OFFICE

CERTIFICATE OF CORRECTION

PATENT NO. : 7,215,920 B2
APPLICATION NO. : 11/107734
DATED : May 8, 2007
INVENTOR(S) : Masanori Shida It is certified that error appears in the above-identified patent and that said Letters Patent is hereby corrected as shown below:

ON THE TITLE PAGE:
At Item (54), Title, "IMAGING" should read --IMAGE--.

COLUMN 1:
Line 1, "IMAGING" should read --IMAGE--.
Line 40, "afore described" should read --aforedescribed--.
Line 58, "happen" should read --happens--.

COLUMN 2:
Line 21, "by" should read --be--.

COLUMN 4:
Line 64, "has" should read --have--.

COLUMN 7:
Line 11, "afore described" should read --aforedescribed--.
Line 28, "while remaining" should be deleted.
Line 55, "afore described" should read --aforedescribed--.

COLUMN 8:
Line 4, "afore described" should read --aforedescribed--.

Signed and Sealed this

Twenty-eighth Day of August, 2007

JON W. DUDAS
*Director of the United States Patent and Trademark Office*